US006329753B1

(12) United States Patent
Makhov

(10) Patent No.: US 6,329,753 B1
(45) Date of Patent: Dec. 11, 2001

(54) M-TYPE MICROWAVE DEVICE WITH SLANTED FIELD EMITTER

(75) Inventor: Vladimir Makhov, Williamsport, PA (US)

(73) Assignee: Litton Systems, Inc., Woodland Hills, CA (US)

( * ) Notice: Subject to any disclaimer, the term of this patent is extended or adjusted under 35 U.S.C. 154(b) by 0 days.

(21) Appl. No.: 09/380,247

(22) PCT Filed: Jan. 5, 1999

(86) PCT No.: PCT/RU99/00001

§ 371 Date: Aug. 30, 1999

§ 102(e) Date: Aug. 30, 1999

(87) PCT Pub. No.: WO99/35662

PCT Pub. Date: Jul. 15, 1999

(30) Foreign Application Priority Data

Jan. 8, 1998 (RU) ..... 98100560

(51) Int. Cl.[7] ..... H01J 25/42; H01J 23/05

(52) U.S. Cl. ..... 315/39.3; 315/39.51; 315/39.63; 313/103 R

(58) Field of Search ..... 315/39.3, 39.51, 315/39.63; 313/103 R; 331/89; 330/47

(56) References Cited

U.S. PATENT DOCUMENTS

| | | | |
|---|---|---|---|
| 2,412,824 | 12/1946 | McArthur . | |
| 2,437,240 | 3/1948 | Brown . | |
| 2,826,719 | 3/1958 | Donal, Jr. | 315/39.63 |
| 2,928,987 | 3/1960 | Peters, Jr. | 315/39.55 |
| 3,121,822 | 2/1964 | Boyd | 315/39.69 |
| 3,297,901 | 1/1967 | MacDonald et al. | 313/346 |
| 3,646,388 | 2/1972 | Dudley et al. | 315/3.5 |
| 3,896,332 | 7/1975 | Heathcote | 315/39.51 |
| 3,899,714 | 8/1975 | Esterson et al. | 315/39.51 |
| 4,677,342 * | 6/1987 | MacMaster et al. | 315/39.51 |
| 5,280,218 | 1/1994 | Smith | 315/39.3 |
| 5,348,934 | 9/1994 | Shaw | 505/125 |
| 5,382,867 | 1/1995 | Maruo et al. | 313/309 |
| 5,463,271 | 10/1995 | Geis et al. | 313/346 R |
| 6,005,347 * | 12/1999 | Lee | 315/39.63 |

FOREIGN PATENT DOCUMENTS

| | | |
|---|---|---|
| 0593768 | 6/1992 | (EP) . |
| 1.306.999 | 9/1962 | (FR) . |
| 2317741 | 12/1996 | (GB) . |
| 2308224 | 6/1997 | (GB) . |
| 62-113335 | 11/1985 | (JP) . |
| 63-226852 | 3/1987 | (JP) . |
| 9-185948 | 10/1996 | (JP) . |
| 98715 | 9/1976 | (RU) . |
| 2040821 | 4/1991 | (RU) . |
| 2007777 | 4/1992 | (RU) . |
| 2071136 | 5/1992 | (RU) . |

(List continued on next page.)

*Primary Examiner*—Benny T. Lee
(74) *Attorney, Agent, or Firm*—Lowe Hauptman; Gilman & Berner, LLP

(57) ABSTRACT

The present invention relates to M-type microwave devices and is aimed to improve effectiveness of using a working surface of field-electron emitters, to improve their reliability while increasing stability of field emission and service life of the device. These objects are solved in the design of a M-type microwave device, comprising an anode encircling a cylindrical evacuated cavity and a cathode assembly disposed co-axially inside the anode, said cathode assembly comprising a cylindrical rod with its surfaces having elements in the form of planar (film) field-electron emitters and secondary-electron emitters that provide a primary and a secondary electron emission, respectively. In doing so, the normal to planar field-electron emitters is not parallel and makes therewith an angle of more than 0 degrees. An end-face of the field-electron emitter is protected by a tunnel-thin dielectric layer containing impurities of various materials and materials having a low work function.

19 Claims, 3 Drawing Sheets

FOREIGN PATENT DOCUMENTS 2051439 1/1993 (RU) .
2115193 3/1994 (RU) .
2115195 4/1996 (RU) .
WO95/26039 3/1995 (WO) .

* cited by examiner

M-TYPE MICROWAVE DEVICE WITH SLANTED FIELD EMITTER

RELATED APPLICATION

The present application claims priority of Russian Application Ser. No. 98/10/0560, filed on Jan. 5, 1999, entitled "M-TYPE MICROWAVE DEVICE", which turn claims priority from Russian Application Ser. No. 98/10/0569 filed Jan. 5, 1999, entitled "MAGNETRON", the disclosures of which are incorporated by reference herein in their entirety.

1. Field of the Invention

The present invention relates generally to the field of electronics and, more particularly, to vacuum electronic devices intended to generate microwave electromagnetic radiation using an electron-transit time, namely to devices known as M-type microwave devices.

More specifically, the present invention relates to structural elements of such devices, namely to cathodes requiring no preliminary incandescence to perform electronic emission.

2. Background of the Invention

In the M-type microwave devices, there are widely used cathodes (which, due to complexity of their structure, would be more accurately identified as cathode assemblies), which make use of a combination of secondary electron emission caused by return to a cathode of a part of electrons traveling in the inter-electrode space along epicycloids, as well as ion bombardment with respect to the cathode, and field emission, that is the phenomenon of electron ejection from a conductor surface under the action of a fairly strong electric field, with the latter emission initiating and maintaining said secondary electron emission.

Methods of improving secondary-emission properties of the cathode are generally known and include fabrication thereof (or its surface coating) from materials such as oxides, in particular oxides of thorium, etc.

A required quantity of field emission is primarily afforded by the shape of corresponding elements and selection of their material, which governs operation of the electron release from a given material into vacuum. Among other things, planar elements (films) having microscopic points (roughness, unevenness) on their lateral surfaces are used as a field-electron emitter. So, the use of such field-emitter located on a focusing flange of the device is described in USSR Inventor's Certificate No. 320,852 granted Nov. 4, 1971 to L. G. Nekrasov et al., for "*Cathode For M-Type Microwave Devices*", Int. Cl. H01J 1/32.

Location of field-electron emitters made in the form of washers along a cathode assembly rod is described in RU Patent No. 2,040,821 granted Jul. 27, 1995 to V. I. Makhov et al., for "*M-Type Microwave Device*", Int. Cl. H01J 1/30. The RU Patent No. 821 is the closest prior art with respect to the present invention.

A need for improving effectiveness of using a working surface of field-electron emitters is still popular in the state of the art, since a field-emission current value is proportional to an emitting area of the field-electron emitter. In view of the fact that a magnetron anode constitutes a cylindrical surface cut by cavity slots, a primary current of the magnetron is dependent upon the location of field-electron emitters relative to an anode cylindrical part having a minimum distance to a working surface of the field-electron emitter.

The increase in primary current to a required value is possible by two ways: either by decreasing a film thickness of the field-electron emitter, resulting in the stepping-up of an electric-field intensity near the surface of an emitter end-face, or by the second way—at the expense of increasing an area participating in the emission, by enlarging a number of field-electron emitters. In doing so, the first way is characterized by augmentation of an effect exerted by electromechanical forces on a field-emission cathode, resulting in the decrease in its mechanical reliability and degradation of its volt-ampere characteristics, whereas the second way is characterized by the fact that a cathode structure of the magnetron becomes more complex, less adaptable to efficient manufacture and less reliable.

SUMMARY OF THE INVENTION

The principal objects of the present invention are: to improve effectiveness of using a working surface of the field-electron emitters; to improve their reliability while increasing stability of field emission and service life of a M-type microwave device, comprising an anode and a cathode having a cylindrical rod with field-electron emitters located on its surface and fabricated as planar discs, and secondary-electron emitters located in the plane perpendicular to a cathode axis, the said emitters providing a primary and secondary emission, respectively.

In accordance with the present invention, these objects are achieved in the arrangement of a M-type microwave device, comprising an anode encircling a cylindrical evacuated cavity and a cathode assembly disposed inside the anode, said cathode assembly comprising a cylindrical rod which is co-axial with the anode, a field-electron emitter made in the form of one or several planar elements mechanically and electrically connected to the cylindrical rod and extending therefrom with a working end-face towards the anode, and a secondary-electron emitter made in the form of one or several sections having an increased secondary electron-emission coefficient, said sections being located on the cylindrical rod surface, the above objects are solved when locating said planar elements such that the normal thereto makes an angle of more than 0 degrees with an axis of the cylindrical rod.

In a preferred embodiment of the present invention, a field-electron emitter in the form of a planar element is located at an angle of more than 5 degrees with respect to a radial plane which is perpendicular to the cylindrical rod axis.

In another preferred embodiment of the present invention, the field-electron emitter in the form of a planar element is located on a spiral path having an axis extending in register with the cylindrical rod axis.

In still another preferred embodiment of the present invention, the field-electron emitter in the form of a planar element is located such that the normal to the surface of said field-electron emitter is perpendicular to the cathode axis. In other words, the planar element surface is located in the plane parallel with an axis passing through the cylindrical rod axis.

According to the present invention, planar elements constituting the field-electron emitter may be isolated with a vacuum gap from those regions (cylindrical rod coatings) which constitute a secondary-electron emitter.

In the preferred embodiments of the present invention, material of field-electron emitters may include impurities of electropositive materials, or impurities of material of the same kind, or both simultaneously, where impurities of material of the same kind are advantageously located at a depth greater than that of the electropositive material.

It is also preferred that a working end-face of said field-electron emitter be fabricated from an amorphous material.

For a number of practical applications, a planar element constituting the field-electron emitter may have cavities in which a film of electropositive material is received. It may be also fabricated with its end-face in the form of a multilayer metal-insulator-metal structure, with each layer having a depth of 2–10 nm.

The field-electron emitter may be fabricated from either tungsten, molybdenum, tantalum, niobium, titanium, or hafnium silicides. It may be also fabricated from amorphous conducting metals and carbide-based alloy, including impurities of electropositive materials.

It is preferred that the working end-faces of planar elements of field-electron emitters be coated with a tunnel-thin dielectric layer also containing impurities of electropositive materials.

Essential distinctions of the proposed M-type microwave device consist in the presence of elements affording primary emission, the elements being disposed on the surfaces the normal to which is not parallel with the cathode axis and makes therewith an angle of more than 0 degrees.

This distinctive feature gives rise to the solution of objectives in accordance with the present invention. In doing so, a primary current increase is attained at the expense of more efficient usage of the working surface of field-electron emitters, since, in accordance with the present design, emission occurs from the larger surface of the emitter.

An additional advantage of the present invention consists in a device simplification at the expense of possibility to reduce a number of field-electron emitters used.

The third advantage of the present invention consists in the stepping down of operating voltage of the device, which makes it possible to expand types of devices used and structural capabilities of field-electron emitters and to employ a wider range of materials and alloys providing stability of volt-ampere characteristics and an extended service life of the devices.

Additional objects and advantages of the present invention will be set forth in the detailed description which follows, and in part will be obvious from the description, or may be learned by practice of the invention.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

Figure 1:
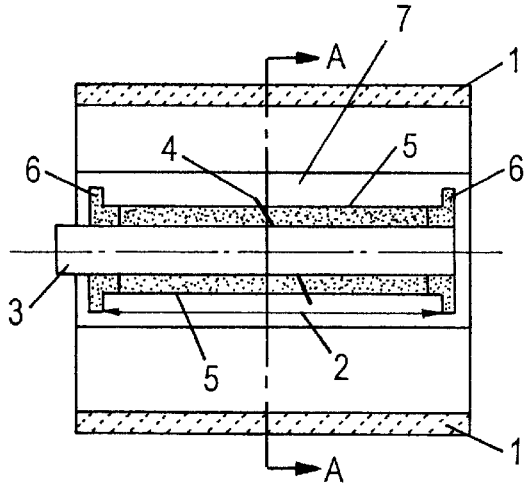
FIG. 1 is a schematic longitudinal (axial) section showing a device in accordance with an embodiment of the present invention.

In the drawings, the following definitions are provided for purposes of clarity and consistency;

1—anode
2—cathode
3—cylindrical rod
4—field-electron emitter
5—secondary-electron emitter
6—focusing electrodes
7—vacuum gap
8—impurities of electropositive materials
9—cavities in the field-electron emitter end-face
10—impurities of materials of the same kind
11—conductor film
12—dielectric film
13—tunnel-thin dielectric layer

DETAILED DESCRIPTION OF THE PREFERRED EMBODIMENTS

Referring now to FIGS. 1–5, there is shown a M-type microwave device comprising a solid anode 1 with an evacuated cylindrical cavity and cavity slots; a cathode 2 disposed in the anode, said cathode comprising a cylindrical rod 3 having a planar (film) field-electron emitter 4, where the normal to the plane of said field-electron emitter is not parallel (in each point of the normal) with the cathode axis and makes therewith an angle of more than 0 degrees; and a secondary-electron emitter 5, the emitters providing primary and secondary electron emission, respectively. Focusing electrodes 6 close the electron interaction distance. A vacuum gap 7 isolates the anode 1 and cathode 2 of the device.

Figure 2:
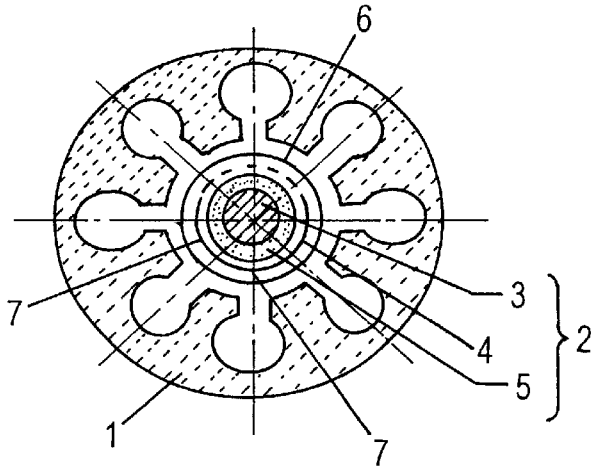
FIG. 2 is a schematic lateral (radial) section showing a device of FIG. 1 taken along the line A—A.
Figure 3:
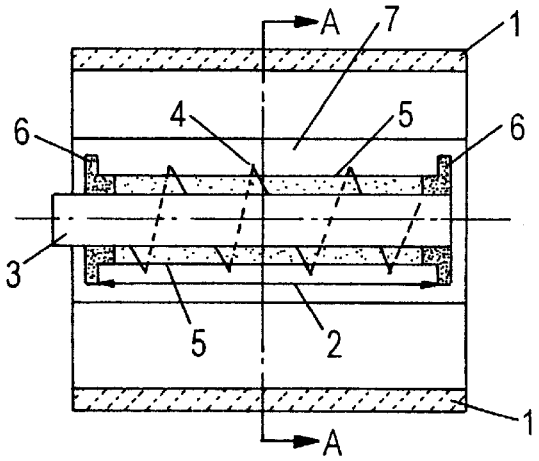
FIG. 3 is a schematic longitudinal (axial) section showing a device in accordance with an embodiment of the present invention.
Figure 4:
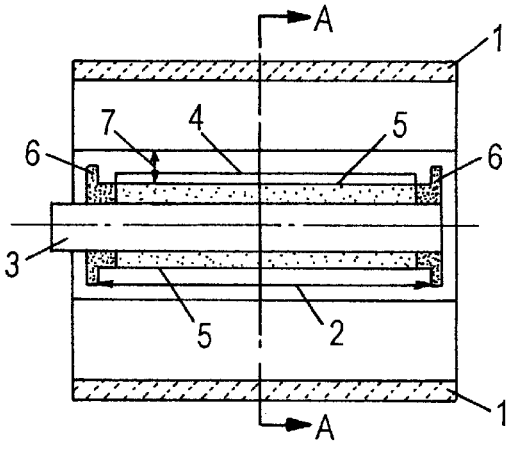
FIG. 4 is a schematic longitudinal (axial) section showing a device in accordance with an embodiment of the present invention.
Figure 5:
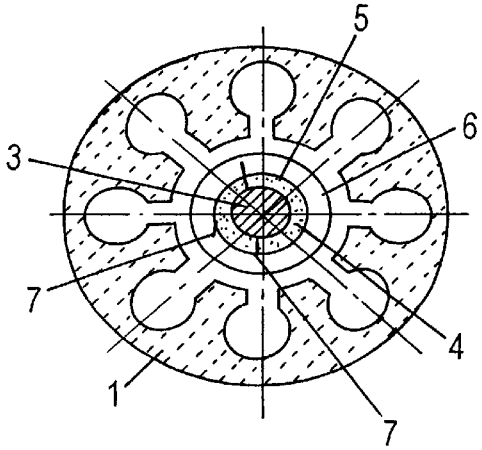
FIG. 5 is a schematic lateral (radial) section showing a device of FIG. 4 taken along the line A—A.

The field-electron emitter may be fabricated from foil with microscopic points over its surface and be shaped as one (or several parallel) circular or ellipsoid disc, as shown in FIGS. 1 and 2, or a rectangle, as shown in FIGS. 4 and 5. The field-electron emitter 5 may comprise several planar elements arranged consecutively in a zigzag path along the axis of the cylindrical rod 3, as shown in FIG. 3. Provision of the field-electron emitter 4 in helical fashion along the rod axis of the cathode 3 facilitates automatic assembly of the cathode and makes it more reliable.

Figure 6:
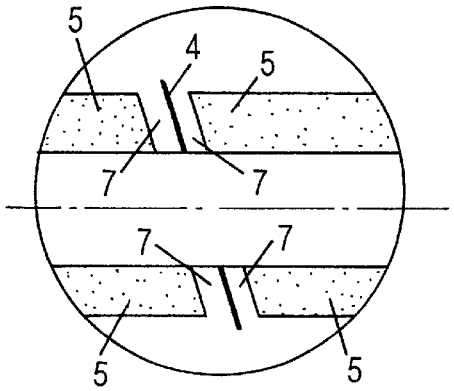
FIG. 6 is a schematic longitudinal (axial) section showing a fragment of the cathode assembly in accordance with an embodiment of the present invention that is, when a field-electron emitter planar element deviates from a radial plane perpendicular to the cylindrical rod axis by more than 5 degrees and is isolated from a secondary-electron emitter with a vacuum gap.

In an embodiment shown in FIG. 6, the field-electron emitter 4 is isolated from the secondary-electron emitter 5 with a vacuum gap 7.

Figure 7:
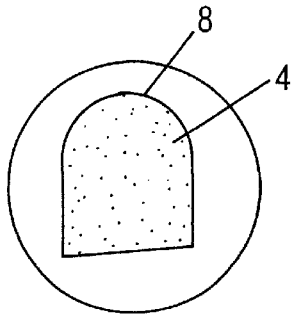
FIG. 7 is a schematic view of the end-face of a field-electron emitter planar element which is doped with impurities of an electropositive material, in accordance with an embodiment of the present invention.

A planar element of the field-electron emitter 4 and particularly its end-face may be doped with impurities of electropositive materials 8, as schematically shown in FIG. 7.

Figure 8:
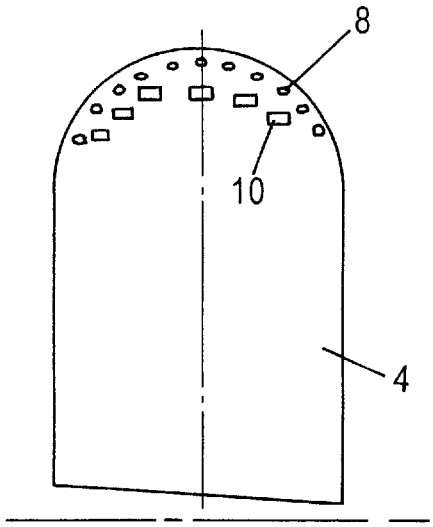
FIG. 8 is a cross-sectional view showing the end-face of a field-electron emitter planar element in which impurities of material of the same kind are located at a depth greater than that of an electropositive material, in accordance with an embodiment of the present invention.

In an embodiment of FIG. 8, there is shown a fragmentary view of the field-electron emitter 4 which is diffusion-stable, mechanically more resistant to ponderomotive loads at the expense of impurities of material of the same kind 10, which are doped at a depth greater than that of impurities of electropositive materials 8 located near the surface of the emitter 4.

Figure 9:
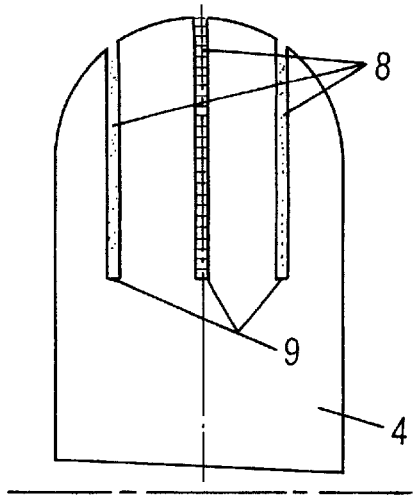
FIG. 9 is a cross-sectional view showing the end-face of a field-electron emitter planar element which contains cavities filled with material having a low work function, in accordance with an embodiment of the present invention.

To enlarge the electropositive material volume, the end-face of a field-electron emitter planar element 4 may be provided with cavities 9 filled with impurities 8 of the above-mentioned material, as shown in FIG. 9.

Figure 10:
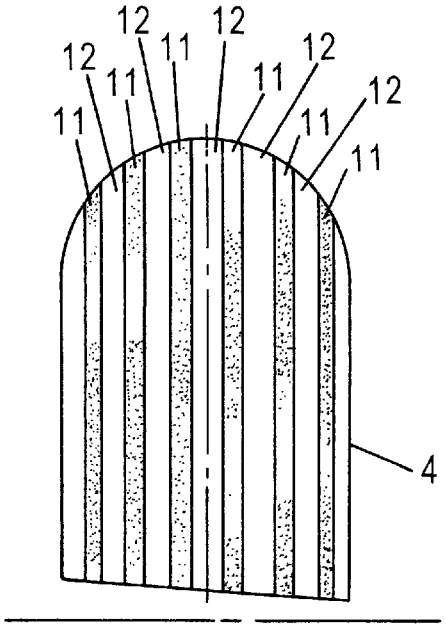
FIG. 10 is a cross-sectional view showing the end-face of a field-electron emitter planar element which is a multilayer metal-insulator-metal structure, in accordance with an embodiment of the present invention.

Referring now to FIG. 10, there is shown another embodiment of the present invention in which a fragmentary end-face of a field-electron emitter planar element 4 is a multilayer structure of conductor 11-insulator 12-conductor 11, with each layer having a depth of 2–10 nm. The field-electron emitter 4 fabricated in such a manner shows an improved strength and low work function.

Figure 11:
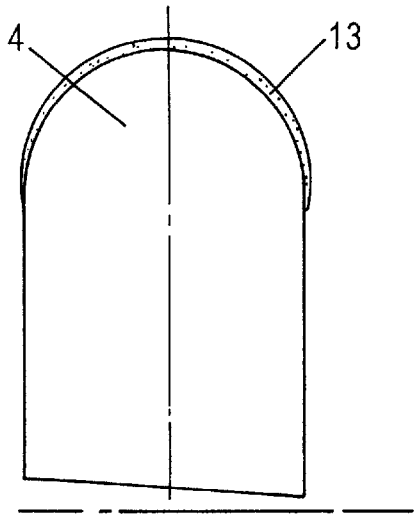
FIG. 11 is a cross-sectional emitter view showing the end-face of a field-electron emitter planar element which is coated with a tunnel-thin dielectric layer, in accordance with an embodiment of the present invention.

FIG. 11 is a cross-sectional view showing the end-face of a field-electron emitter planar element 4 which is coated with a tunnel-thin dielectric layer 13, in accordance with an embodiment of the present invention. Thanks to such a coating, the field-electron emitter shows high stability.

A microwave device in accordance with the present invention operates as follows.

The anode is connected to ground. Negative operating voltage is applied to the cathode. Primary excitation current is ensured by field emission. Emitted field-electrons, accelerating and changing direction of their traffic under the action of electromagnetic field microwaves, partly fall on the element that provides secondary electron emission, thus knocking out secondary electrons which, in turn, being multiplied in avalanche-like fashion, provide for an operating current of the device.

M-type microwave devices in accordance with the present invention are more reliable when triggering, more efficient technologically and more effective economically.

INDUSTRIAL APPLICABILITY

The proposed invention may be widely used in vacuum electronics when designing highly-efficient instant-excitation microwave devices.

Although the present invention has been described with reference to a preferred embodiment, the invention is not limited to the details thereof, and various changes and modifications obvious to one skilled in the art to which the invention pertains are deemed to be within the spirit, scope and contemplation of the invention as further defined in the appended claims.

What is claimed is:

1. A M-type microwave device comprising an anode encircling a cylindrical evacuated cavity and surrounding a cathode assembly disposed inside the cavity, said cathode assembly comprising:

a cylindrical rod which is co-axial with the anode;

a field-electron emitter comprising at least one planar element with a working end-face, said planar element being mechanically and electrically connected to the cylindrical rod and extending therefrom with the working end-face towards the anode;

and a secondary-electron emitter comprising a coating on at least a portion of a side surface of the cylindrical rod, said secondary-electron emitter having an increased secondary-electron emission coefficient;

wherein said at least one planar element has a respective normal which makes an angle of more than 0 degrees with an axis of the cylindrical rod.

2. The M-type microwave device according to claim 1, wherein said at least one planar element extends radially from the cylindrical rod toward the anode.

3. The M-type microwave device according to claim 2, wherein said at least one planar element has a rectangular shape and extends along the axis of the cylindrical rod.

4. The M-type microwave device according to claim 1, wherein said at least one planar element is arranged at an angle of more than 5 degrees with respect to a radical plane which is perpendicular to the axis of the cylindrical rod.

5. The M-type microwave device according to claim 2 characterized in that the field-electron emitter is isolated from the secondary-electron emitter with a vacuum gap.

6. The M-type microwave device according to claim 4, wherein a material of the working end-face of said at least one planar element is doped with impurities of at least one elctropositive material.

7. The M-type microwave device according to claim 6, wherein said material of the working end-face of said at least one planar element includes impurities of a material of the same kind being located at a depth greater than that of the at least one electropositive material.

8. The M-type microwave device according to claim 4, wherein a material of the working end-face of said at least one planar element includes impurities of a material of the same kind.

9. The M-type microwave device according to claim 4, wherein the field-electron emitter is made of an amorphous material.

10. The M-type microwave device according to claim 4, wherein the working end-face of said at least one planar element contains cavities in which a material having a low work function is contained.

11. The M-type microwave device according to claim 4, wherein the working end-face of said at least one planar element is a multilayer metal-insulator-metal structure with each layer having a depth of 2–10 nm.

12. The M-type microwave device according to claim 4, wherein the field-electron emitter is fabricated from material selected from the group consisting of tungsten, niobium, tantalum, titanium, molybdenum silicides.

13. The M-type microwave device according to claim 4 characterized in that the field-electron emitter is fabricated from material selected from the group consisting of amorphous conducting metals and carbide-based alloys.

14. The M-type microwave device according to claim 13, characterized in that amorphous conducting metals and alloys are doped with impurities of electropostitive materials.

15. The M-type microwave device according to claim 4, wherein the working end-face of said at least one planar element is coated with a tunnel-thin dielectric layer.

16. The M-type microwave device according to claim 15, characterized in that said tunnel-thin dielectric layer contains impurities of electropositive materials.

17. The M-type microwave device according to claim 1, wherein said secondary-electron emitter comprises in said coating a slit in which said at least one planar element is positioned, spaced from said coating.

18. The M-type microwave device according to claim 1, wherein said at least one planar element comprises one of a circular disc and a ellipsoid disc.

19. The M-type microwave device according to claim 1, wherein said field-electron emitter comprises a plurality of planar elements, said plurality of planar elements are slanted with respect to the axis of the cylindrical rod and are arranged consecutively in a zigzag path along the axis of the cylindrical rod.

* * * * *